US010182608B2

(12) United States Patent
Smith et al.

(10) Patent No.: US 10,182,608 B2
(45) Date of Patent: Jan. 22, 2019

(54) ARTICLE WITH ILLUMINATING SURFACE

(71) Applicant: NIKE, Inc., Beaverton, OR (US)

(72) Inventors: Mark J. Smith, Portland, OR (US); Andrew A. Owings, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 268 days.

(21) Appl. No.: 14/608,425

(22) Filed: Jan. 29, 2015

(65) Prior Publication Data

US 2016/0219967 A1 Aug. 4, 2016

(51) Int. Cl.

| | |
|---|---|
| ***F21V 33/00*** | (2006.01) |
| ***A43B 3/00*** | (2006.01) |
| ***A43C 11/00*** | (2006.01) |
| ***A43B 1/00*** | (2006.01) |
| ***A43B 23/02*** | (2006.01) |

(52) U.S. Cl.

CPC ..... *A43B 3/001* (2013.01); *A43B 1/0072* (2013.01); *A43B 23/0235* (2013.01); *A43B 23/0245* (2013.01); *A43C 11/008* (2013.01); *F21V 33/0008* (2013.01); *F21V 33/0004* (2013.01)

(58) Field of Classification Search

CPC ... F21L 4/00; F21V 33/0008; F21W 2121/06; F21Y 2103/006; F21Y 2105/006; Y02B 20/32; Y10S 428/917; A43B 23/26; A43B 3/001; A43B 3/16–3/22

See application file for complete search history.

(56) References Cited

U.S. PATENT DOCUMENTS

| | | | | |
|---|---|---|---|---|
| 5,329,432 | A * | 7/1994 | Bland | A43B 1/0036 36/137 |
| 5,879,069 | A | 3/1999 | Chien | |
| 6,843,578 | B1 * | 1/2005 | Cheung | A43B 1/0027 362/103 |
| 7,329,019 | B2 | 2/2008 | Cheung | |
| 7,428,471 | B2 | 9/2008 | Darley et al. | |
| 7,650,705 | B2 * | 1/2010 | Donnadieu | A43B 5/0411 36/45 |
| 7,771,320 | B2 | 8/2010 | Riley et al. | |
| 7,789,520 | B2 | 9/2010 | Konig et al. | |
| 8,056,269 | B2 | 11/2011 | Beers et al. | |
| 8,112,251 | B2 | 2/2012 | Case, Jr. et al. | |
| 2002/0066208 | A1 * | 6/2002 | Hall | A43B 3/0078 36/7.3 |
| 2004/0250452 | A1 * | 12/2004 | Farys | A43B 5/002 36/89 |
| 2005/0111210 | A1 | 5/2005 | Ono | |
| 2005/0183294 | A1 * | 8/2005 | Guzman | A43B 3/0005 36/137 |
| 2006/0198121 | A1 | 9/2006 | Thorpe et al. | |
| 2006/0221596 | A1 | 10/2006 | Chang | |
| 2007/0021269 | A1 | 1/2007 | Shum | |
| 2007/0028486 | A1 | 2/2007 | Montanya et al. | |

(Continued)

FOREIGN PATENT DOCUMENTS

JP 10-50101 A 2/1998

*Primary Examiner* — Zheng Song

(74) *Attorney, Agent, or Firm* — Banner & Witcoff, Ltd.

(57) ABSTRACT

An article of footwear includes an upper assembly with an upper and an upper covering member. The upper covering member includes a lighting panel layer capable of illuminating the upper covering member. A majority of the upper covering member may be configured to illuminate.

43 Claims, 10 Drawing Sheets

(56) References Cited

U.S. PATENT DOCUMENTS

| | | | | |
|---|---|---|---|---|
| 2009/0158622 | A1* | 6/2009 | Cook | A43B 1/0036 36/137 |
| 2010/0063778 | A1 | 3/2010 | Schrock et al. | |
| 2010/0321928 | A1* | 12/2010 | Yang | A43B 1/0072 362/103 |
| 2011/0032105 | A1 | 2/2011 | Hoffman et al. | |
| 2011/0192059 | A1 | 8/2011 | Spanks et al. | |
| 2011/0199393 | A1 | 8/2011 | Nurse et al. | |
| 2012/0078396 | A1 | 3/2012 | Case, Jr. et al. | |
| 2012/0188750 | A1* | 7/2012 | Marston | A43B 3/0015 362/103 |
| 2012/0234111 | A1 | 9/2012 | Molyneux et al. | |
| 2012/0251079 | A1 | 10/2012 | Meschter et al. | |
| 2012/0291563 | A1 | 11/2012 | Schrock et al. | |
| 2012/0291564 | A1 | 11/2012 | Amos et al. | |
| 2013/0213144 | A1 | 8/2013 | Rice et al. | |
| 2013/0213147 | A1 | 8/2013 | Rice et al. | |
| 2013/0291408 | A1* | 11/2013 | Fusco | A43B 23/24 36/136 |
| 2014/0185275 | A1* | 7/2014 | Smith, III | A43B 3/001 362/103 |
| 2015/0077978 | A1* | 3/2015 | Chen | A43B 3/001 362/103 |

* cited by examiner

ARTICLE WITH ILLUMINATING SURFACE

BACKGROUND

The present embodiments relate generally to articles of footwear, and in particular to articles of footwear with uppers.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one aspect an article of footwear includes an upper and a sole structure. The article has a first exposed surface and a second exposed surface, where the first exposed surface is disjoint from the second exposed surface. The first exposed surface and the second exposed surface together comprise a total exposed surface for the article of footwear. The second exposed surface corresponds to an exposed surface of the sole structure. The article of footwear has an illuminated state and a non-illuminated state. The article of footwear further includes a forefoot portion, a midfoot portion and a heel portion. The article of footwear includes an illumination zone associated with the first exposed surface. The illumination zone extends continuously from the forefoot portion to the midfoot portion.

In another aspect, an article of footwear includes a sole structure, an upper and an upper covering member. The upper covering member is exterior to the upper and covers at least a portion of the upper. The upper covering member has an exposed surface. The article of footwear has an illuminated state and a non-illuminated state. The upper covering member includes an illumination zone associated with the exposed surface. The illumination zone extends continuously from a lower periphery of the upper covering member to an upper periphery of the upper covering member, where the lower periphery is disposed adjacent to the sole structure and where the upper periphery is associated with a cuff portion of the article of footwear.

In another aspect, an article of footwear includes a sole structure, an upper and an upper covering member. The upper covering member is disposed outwardly of the upper and the upper covering member covers a majority of the upper. The upper covering member has a forefoot portion, a midfoot portion and a heel portion, where the midfoot portion extends continuously between the forefoot portion and the heel portion. The article of footwear has a non-illuminated state and an illuminated state. The article of footwear includes an illumination zone, the illumination zone being illuminated when the article of footwear is in the illuminated state. The illumination zone extends continuously from the forefoot portion to the heel portion.

In another aspect, an article of footwear includes a sole structure, an upper and an upper covering member. The upper covering member is disposed outwardly of the upper and the upper covering member covers a majority of the upper. The upper covering member further comprises an outer layer, an intermediate layer and an inner layer, where the intermediate layer is a light producing layer. The intermediate layer separates the outer layer and the inner layer. The article of footwear has a non-illuminated state and an illuminated state; and the intermediate layer is illuminated when the article of footwear is in the illuminated state.

In another aspect, an article of footwear includes a sole structure and an upper, the upper having an exposed surface and the article of footwear having an illuminated state and a non-illuminated state. The upper includes an illumination zone associated with the exposed surface and the illumination zone extends continuously from a lower periphery of the upper to an upper periphery of the upper. The lower periphery is disposed adjacent to the sole structure and the upper periphery is associated with a cuff portion of the article of footwear.

In another aspect, an article of footwear includes a sole structure and an upper. The upper has a forefoot portion, a midfoot portion and a heel portion, where the midfoot portion extends continuously between the forefoot portion and the heel portion. The article of footwear has a non-illuminated state and an illuminated state. The article of footwear includes an illumination zone, the illumination zone is illuminated when the article of footwear is in the illuminated state. The illumination zone extends continuously from the forefoot portion to the heel portion.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
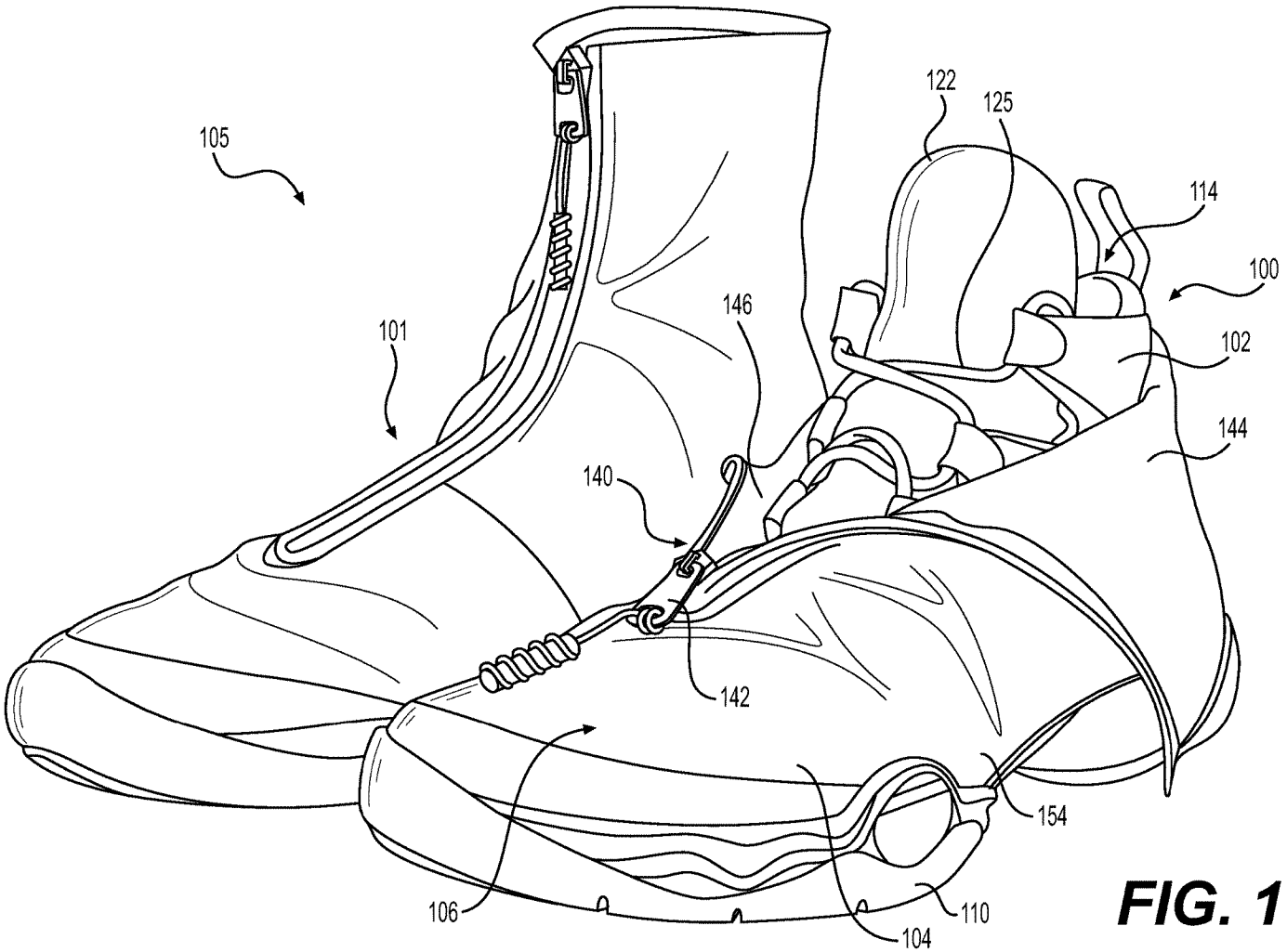
FIG. 1 is an isometric view of an embodiment of a pair of articles of footwear, where each article includes an upper covering member.

FIG. 1 illustrates an isometric view of an embodiment of a pair of articles of footwear 105 including article of footwear 100 and article of footwear 101. In the exemplary embodiment, articles of footwear 105 have the form of basketball shoes. However, in other embodiments, the provisions discussed herein for articles of footwear 105 could be incorporated into various other kinds of footwear including, but not limited to: hiking boots, soccer shoes, football shoes, sneakers, running shoes, cross-training shoes, rugby shoes, baseball shoes as well as other kinds of shoes. Moreover, in some embodiments, the provisions discussed herein for articles of footwear 105 could be incorporated into various other kinds of non-sports related footwear, including, but not limited to: slippers, sandals, high heeled footwear, and loafers.

For purposes of clarity, the following detailed description discusses the features of article of footwear 100, also referred to simply as article 100. However, it will be understood that article of footwear 101 may share some, and possibly all, of the features of article 100 described herein and shown in the figures.

As shown in FIG. 1, article 100 may comprise an upper 102 and a sole structure 110. In some embodiments, article 100 may include an upper covering member 104. Upper 102 and upper covering member 104 may be collectively configured as an upper assembly 106.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, hardwood flooring, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional. Further details of sole structure 110, including optional features for accommodating power components and/or sensors, are discussed in further detail below.

Figure 6:
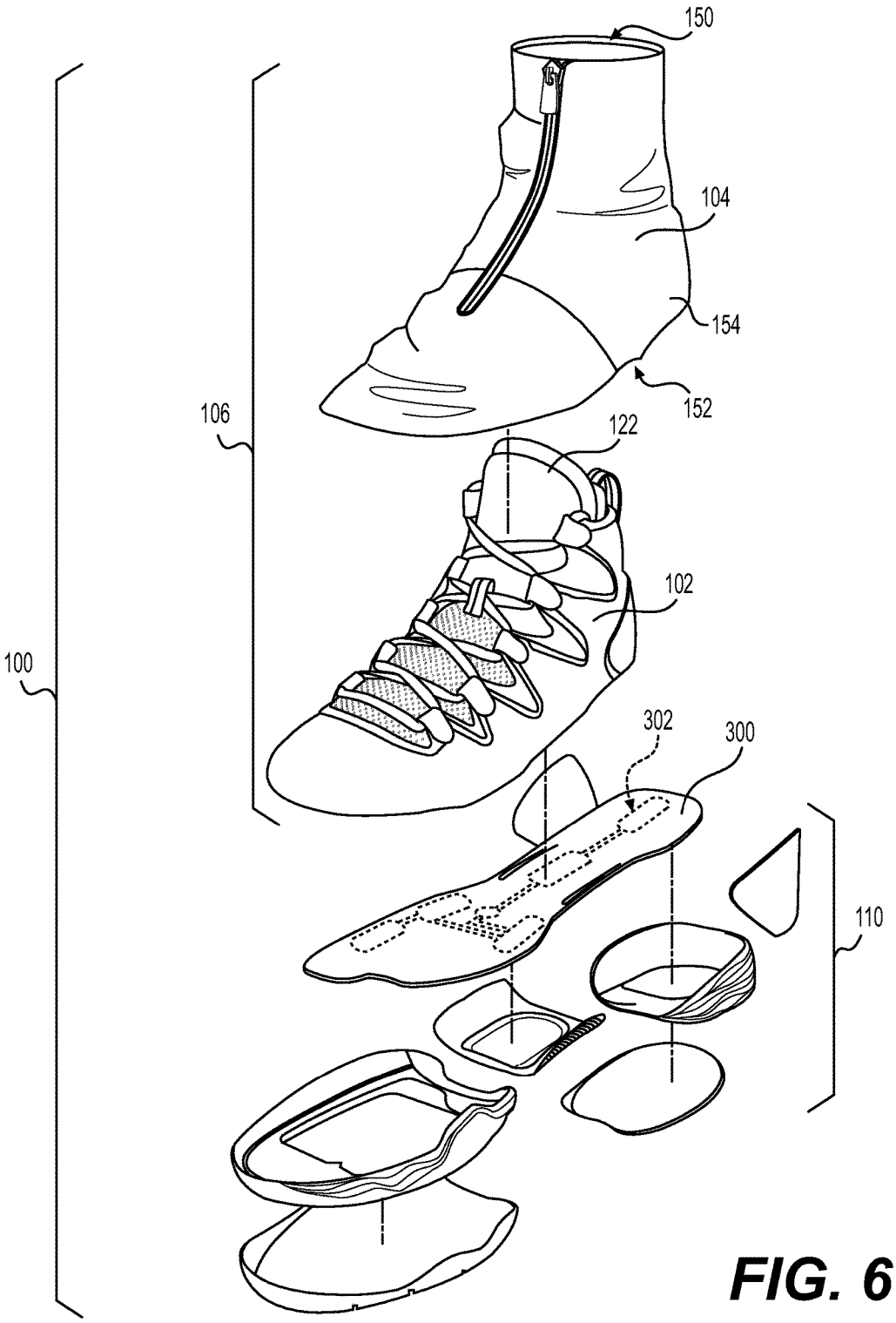
FIG. 6 is an exploded isometric view of an embodiment of an article of footwear with an upper covering member.
Figure 7:
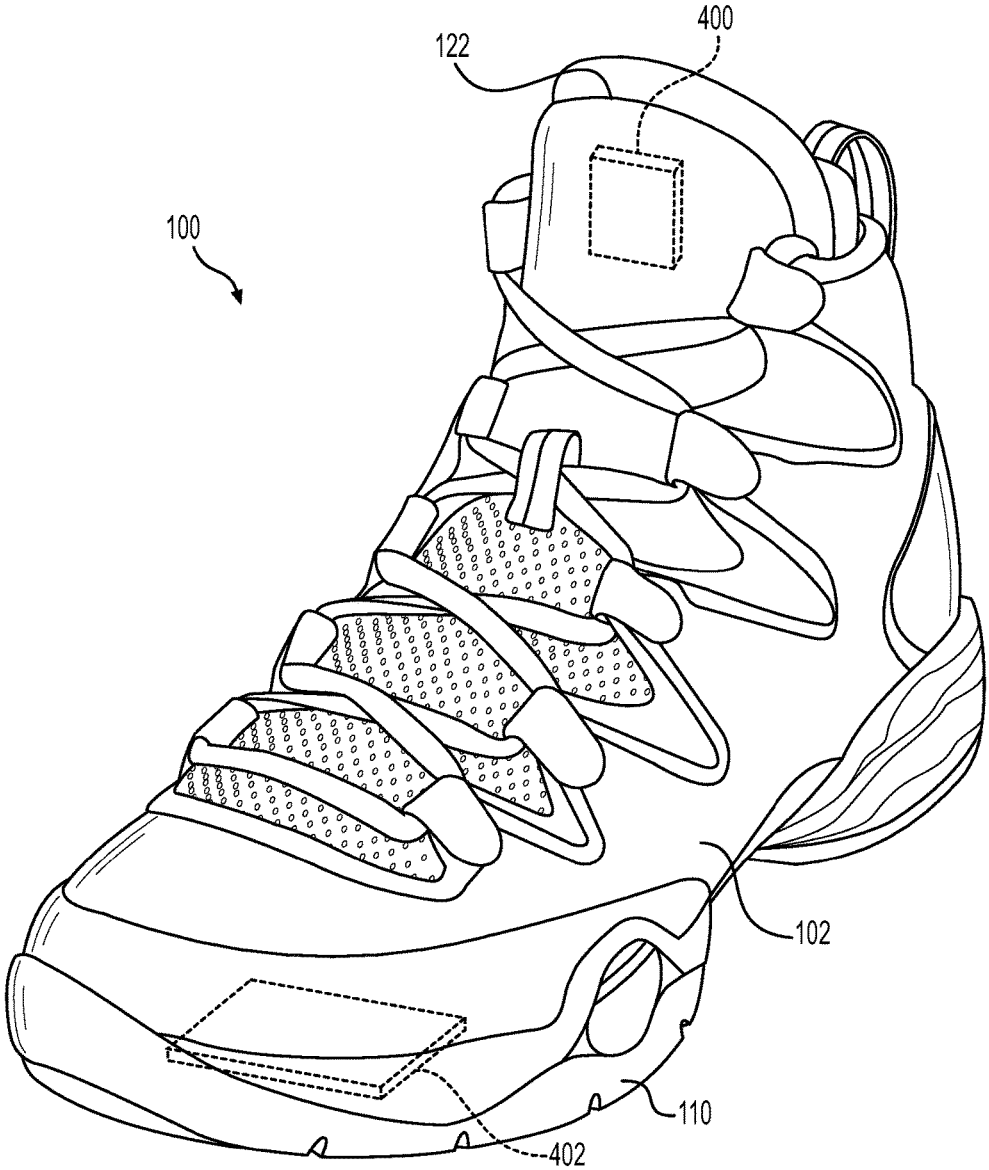
FIG. 7 is an isometric view of the article of footwear of FIG. 6 without the outer covering member shown.

Upper 102, which is also clearly shown in FIGS. 6 and 7, may include a variety of provisions for receiving and covering a foot, as well as securing article 100 to the foot. In some embodiments, upper 102 includes opening 114 that provides entry for the foot into an interior cavity of upper 102. In some embodiments, upper 102 may include a tongue 122 that provides cushioning and support across the instep of the foot. Some embodiments may include fastening provisions, including, but not limited to: laces, cables, straps, buttons, zippers as well as any other provisions known in the art for fastening articles. In some embodiments, a lace 125 may be applied at a fastening region of upper 102.

In different embodiments, upper 102 may have a variety of different configurations. In particular, upper 102 may have any design, shape, size and/or color. For example, in the exemplary embodiment article 100 is a basketball shoe and so therefore upper 102 may have a high-top configuration that is shaped to provide high support on an ankle. In other embodiments, however, upper 102 could be configured as a low top upper for running or other activities.

Upper assembly 106 may be configured with provisions for projection and/or support. In some embodiments, for example, upper assembly 106 includes a heel counter 109, best seen in FIGS. 2-5. In some cases, heel counter 109 may be disposed over upper 102 and upper covering member 104. In other cases, however, heel counter 109 could be disposed beneath (e.g., interior of) upper covering member 104. Alternatively, in other embodiments, article 100 may not include a heel counter.

Upper covering member 104 may be configured to cover portions of article 100. In the exemplary embodiment, upper covering member 104 may be configured to cover upper 102. However, in other embodiments, an upper covering member could cover portions of a sole structure as well.

Upper covering member 104 may include a fastening system 140. In one embodiment, fastening system 140 comprises a zipper 142 that can be used to fasten an opposing first side 144 and second side 146 of upper covering member 104. Such a configuration may allow upper covering member 104 to be partially opened so that a user has access to lace 125 of upper 102. Alternatively, in other embodiments, a different kind of fastening system could be used. In still other embodiments, no fastening system may be used. In some cases, it might be possible to access lace 125 through an uppermost opening of upper covering member 104, and/or by retracting the collar of upper covering member 104 around the top of upper 102.

Figure 4:
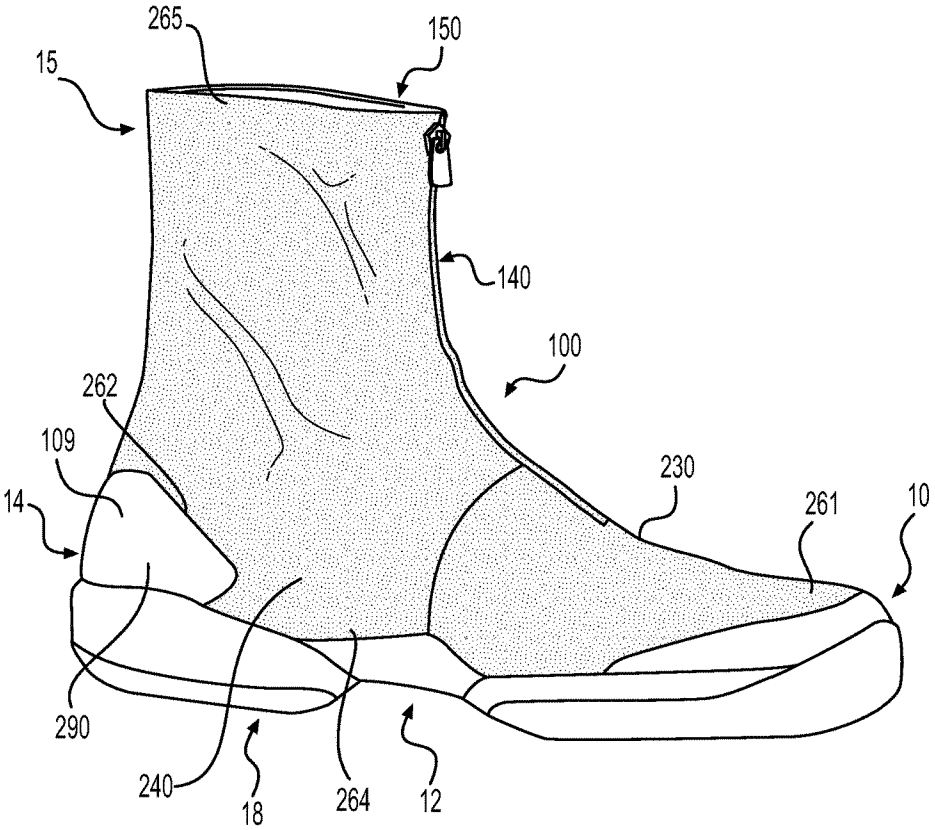
FIG. 4 is a side view of an embodiment of an article of footwear in an illuminated state.

When zipper 142 secures upper covering member 104 in a closed position, upper covering member 104 may form an upper ankle opening 150, as clearly shown in FIG. 4. In addition, as indicated in FIG. 6, upper covering member 104 may include a bottom opening 152 bounded by a lower peripheral edge 154. In the closed position, upper covering member 104 may cover most, and possibly all, of upper 102. Thus, upper covering member 104 may act as a barrier to shield upper 102 from the environment. Moreover, in some cases, upper covering member 104 may provide a unique aesthetic appearance to traditional upper styles visible on the exterior of an article of footwear. In some embodiments, upper covering member 104 may be configured as a shroud that covers upper 102.

In some embodiments, upper covering member 104 could be permanently attached to upper 102 and/or sole structure 110. In one embodiment, lower peripheral edge 154 of upper covering member 104 could be stitched, bonded, welded, or otherwise secured, to upper 102. In another embodiment, lower peripheral edge 154 of upper covering member 104 could be stitched, bonded, welded, or otherwise secured, to sole structure 110. In still other embodiments, upper covering member 104 may not be permanently attached to upper 102 and/or sole structure 110. For example, in an alternative embodiment, upper covering member 104 could be detachable. In some cases, upper covering member 104 could be temporarily fixed to upper 102 and/or sole structure 110 using hook and loop fasteners, buttons, snaps, zippers and/or other provisions.

Embodiments can include provisions for lighting a substantial majority of the outer surface of an article of footwear. In some embodiments, articles can include an upper covering member that can be illuminated.

Figure 3:
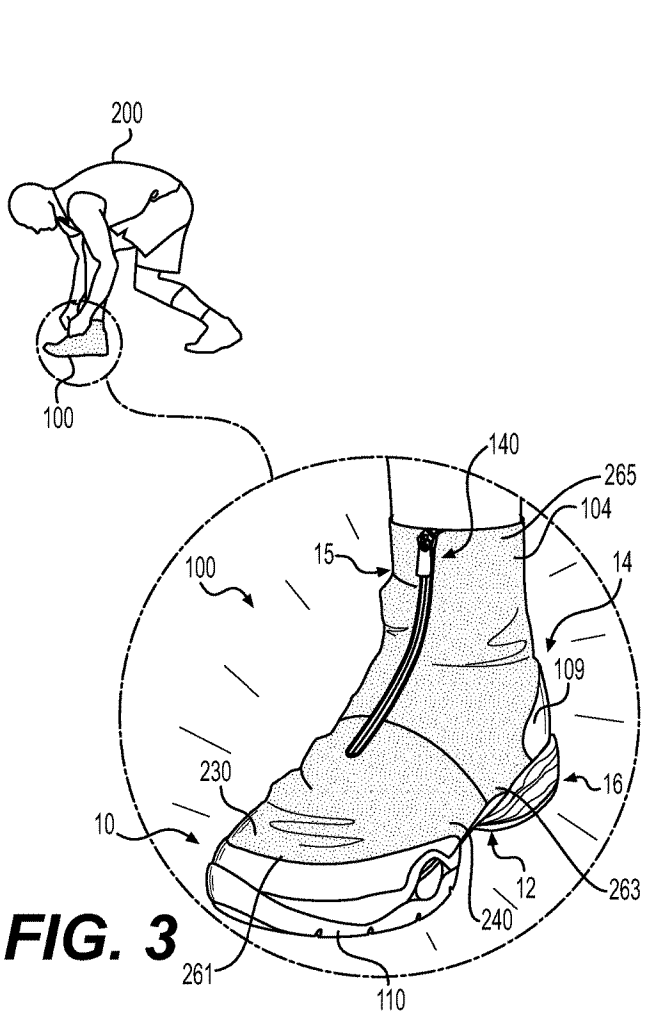
FIG. 3 is a schematic view of a user wearing a pair of footwear, including an enlarged view of an embodiment of an article of footwear in an illuminated state.
Figure 2:
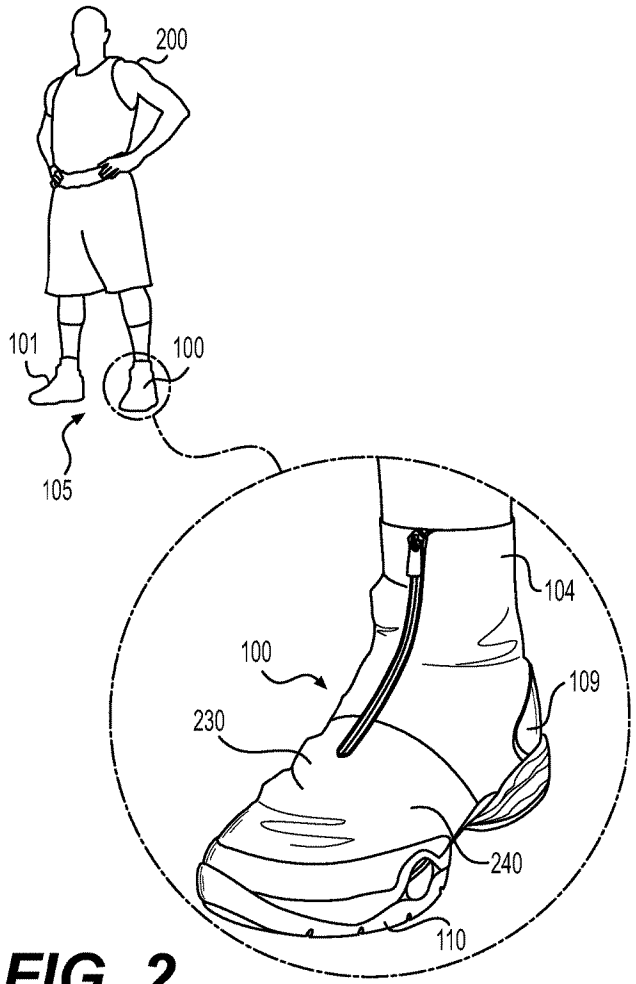
FIG. 2 is a schematic view of a user wearing a pair of footwear, including an enlarged view of an embodiment of an article of footwear in a non-illuminated state.

FIGS. 2 and 3 illustrate schematic views of a user 200 wearing pair of articles of footwear 105, including article 100. FIG. 2 shows an enlarged view of article 100 in a non-illuminated state. As seen in FIG. 3, user 200 may activate article 100 so that article 100 changes to an illuminated state. More specifically, in this illuminated state, upper covering member 104 may become illuminated. In the exemplary embodiment, sole structure 110 is not illuminated. Moreover, upper 102 may not be illuminated, and most or all of upper 102 may not be visible through upper covering member 104. For purposes of illustration, the illuminated state of upper covering member 104 is indicated schematically with stippling.

Figure 5:
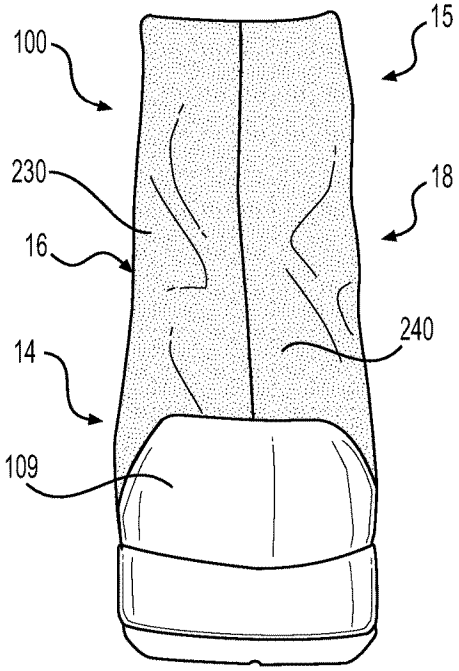
FIG. 5 is a rear view of an embodiment of an article of footwear in an illuminated state.

FIGS. 3 through 5 illustrate various views of article 100 while upper covering member 104 is illuminated. Specifically, FIG. 3 illustrates a lateral isometric view of article 100, FIG. 4 illustrates a medial view of article 100 and FIG. 5 illustrates a rear view of article 100. As seen in FIGS. 3-5, a substantial majority article 100 may be illuminated in the illuminated state.

The embodiments may be characterized by various directional adjectives and reference portions. These directions and reference portions may facilitate in describing the portions of an article of footwear, including an upper and/or upper covering member, which may be illuminated when an article is in an illuminated state.

For consistency and convenience, directional adjectives are employed throughout this detailed description corresponding to the illustrated embodiments. The term "longitudinal" as used throughout this detailed description and in the claims refers to a direction extending a length of a component (e.g., an upper or upper assembly). In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. This detailed description makes use of these directional adjectives in describing an article and various components of the article, including an upper and/or upper covering member.

Article 100 may be characterized by a number of different regions or portions. For example, article 100 could include a forefoot portion, a midfoot portion, a heel portion and an ankle portion. Moreover, components of article 100 could likewise comprise corresponding portions. Referring to FIGS. 3-5, upper covering member 104 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. Article 100 may also include an ankle portion 15. In addition, upper covering member 104 may include lateral side 16 and medial side 18. In particular, lateral side 16 and medial side 18 may be opposing sides of upper covering member 104. Furthermore, both lateral side 16 and medial side 18 may extend through forefoot portion 10, midfoot portion 12, heel portion 14 and ankle portion 15.

In the exemplary embodiment if FIGS. 3-5, upper covering member 104 consists of forefoot portion 10, midfoot portion 12, heel portion 14 and ankle portion 15. In other words, every portion of upper covering member 104 is associated with one of forefoot portion 10, midfoot portion 12, heel portion 14 and ankle portion 15. Further, in the exemplary embodiment, midfoot portion 12 may extend continuously between forefoot portion 10 and heel portion 14.

An upper covering member may cover at least some portions of an upper. In some embodiments, an upper covering member could cover at least 25% of an exterior (or outer) surface of an upper. In some embodiments, an upper covering member could cover at least 50% of an exterior surface of an upper. In some embodiments, an upper covering member could cover at least 75% of an exterior surface of an upper. In still further embodiments, an upper covering member could cover at least 90% of an exterior surface of an upper. In some embodiments, an upper covering member could cover a substantial entirety of an upper (e.g., approximately 100%).

As seen in FIGS. 3-5, upper covering member 104, which is disposed outwardly of upper 102, may cover a substantial majority of upper 102. In this embodiment, upper covering member 104 covers substantially all of the exterior surface of upper 102 when upper covering member 104 is closed (e.g., zipped). In other words, upper covering member 104 may cover in the range of 95% to 100% of the total exterior surface area of upper 102.

One or more components of an article may have an exposed surface (or exposed surface area). As used herein, the term "exposed surface" (or alternatively, "exposed surface area") refers to the portion of a component's surface that is exposed or made visible on an article of footwear. Thus, for example, a sole structure may include an exposed surface comprised of peripheral sidewalls and a lower sole surface that are visible on the article of footwear. Exposed surfaces may not be covered over by other components of an article, or otherwise obscured from view at all times. Of course, different exposed surfaces will be visible to a user depending on the viewing angle. Moreover, while various components may have surfaces that are exterior or outer in relation to other components, the term "exposed surface" refers specifically to surfaces that are visible on an outermost, or exterior, surface of the entire article of footwear. Thus, the exposed surface of any component may be seen to comprise some or all of the outermost, or exterior, surface of the article of footwear.

Upper covering member 104 may comprise an exposed surface 230. Exposed surface 230 includes all those portions of upper covering member 104 that can be seen on article 100 when article 100 is worn, but not portions that are hidden and/or covered by other provisions (e.g., portions hidden by external support elements, trim, etc.). Furthermore, the exterior surface of article 100 may be the combination of the exposed surfaces of upper covering member 104, upper 102 and sole structure 110.

The illumination of article 100 may be characterized by the percentage of the exposed surface of upper covering member 104 that is illuminated in the illuminated state. In some embodiments, at least 50% of the exposed surface may be illuminated in the illuminated state. In some other embodiments, at least 80% of the exposed surface may be illuminated in the illuminated state. In some other embodiments, at least 90% of the exposed surface may be illuminated in the illuminated state. In some other embodiments, at least 95% of the exposed surface may be illuminated in the illuminated state.

Referring to FIG. 2 in the non-illuminated state, no portions of upper covering member 104 are illuminated. Thus, the exposed surface 230 is not illuminated in the non-illuminated state of article 100. In contrast, referring to FIGS. 3-5, in the illuminated state substantially the entirety of exposed surface 230 is illuminated. In particular, it may be seen that substantially all, or approximately 95% to 100%, of the exposed surface of upper covering member 104 may be illuminated in the illuminated state. In some cases, some relatively small portions or regions may not be illuminated, such as portions or regions associated with fastening system 140.

Upper covering member 104 may also be characterized as having one or more illumination zones. As used herein, the term "illumination zone" refers a zone, region or portion of a component that is configured to be illuminated (e.g., which has provisions for illumination). Some embodiments could incorporate two or more disjoint (e.g., non-overlapping zones).

An illumination zone may extend continuously through various portions of an upper covering member. An illumination zone may be disposed in one or more portions, including a forefoot portion, a midfoot portion, a heel portion, an ankle portion and/or a combination of two or more portions. In some embodiments, an illumination zone could extend continuously from a forefoot portion to a midfoot portion. In other embodiments, an illumination zone could extend continuously from a midfoot portion to a heel portion. In other embodiments, an illumination zone could extend continuously from a forefoot portion to a heel portion. In other embodiments, an illumination zone could extend continuously from a heel portion to an ankle portion. In still other embodiments, an illumination zone could extend continuously from a medial side of an upper covering member to a lateral side of the upper covering member.

In the exemplary embodiment of FIGS. 3-5, upper covering member 104 includes a single illumination zone 240 that extends continuously throughout substantially all of exposed surface 230. Specifically, illumination zone 240 extends continuously through forefoot portion 10, midfoot portion 12, heel portion 14 and ankle portion 15. Illumination zone 240 also extends on both lateral side 16 and medial side 18 of upper covering member 104. Thus, as may be seen in FIGS. 3-5, each of forefoot portion 10, midfoot portion 12, heel portion 14 and ankle portion 15, on both the lateral side 16 and medial side 18, are illuminated in the illuminated state.

As seen in FIGS. 3-5, illumination zone 240 may extend to the lower periphery and upper periphery of upper covering member 104. In particular, as best seen in FIGS. 3-4, illumination zone 240 may extend to a forward-most edge 261 of upper covering member 104. Likewise, as best seen in FIG. 4, illumination zone 240 may extend to a rearward-most edge 262 of upper covering member 104. In this particular case, the rearward-most edge 262 of upper covering member 104 is disposed adjacent to an edge 290 of heel counter 109. As shown in FIGS. 3-4, illumination zone 240 may also extend to a lower peripheral lateral edge 263 and to lower peripheral medial edge 264. Here, forward-most edge 261, rearward-most edge 262, lower peripheral lateral edge 263 and lower peripheral medial edge 264 may together comprise a lower periphery of upper covering member 104. Further, illumination zone 240 may extend to upper peripheral edge 265 of upper covering member 104, which provides a boundary to opening 150. In some cases, the upper periphery, or upper peripheral edge 265 of upper covering member 104 may be associated with a cuff portion of article 100.

Illumination zone 240 may be characterized as being a connected illumination zone or region. As used herein, a "connected illumination zone" is an illumination zone where no two illuminable portions of the zone are completely separated. Specifically, any two illuminable portions of a connected illumination zone may be connected continuously (e.g., without a break in illumination) by an intermediate portion of material that is also illuminable. As a specific example, forefoot portion 10 and heel portion 14 are both within illumination zone 240 and are likewise connected by an intermediate portion (midfoot portion 12), which is also in illumination zone 240.

While the embodiment of FIGS. 2-5 illustrate a single connected illumination zone on upper covering member 104, it is contemplated that in other embodiments an upper covering member could comprise several disjoint zones, which are themselves connected illumination zones. Thus, for example, some embodiments could include two, three, four or more disjoint illumination zones, where each of the disjoint illumination zones are connected illumination zones, and which together comprise a majority of the exterior surface area of the upper covering member.

An upper covering member may be associated with a total illuminable surface area. As used herein, the "total illuminable surface area" of an upper covering member is the total area of the upper covering member that can be illuminated in the illuminated state. The total illuminable surface area may correspond to the surface area of one or more different illumination zones (e.g., two separated illumination zones on the medial and lateral sides). In different embodiments, the value of the total illuminable surface area could vary. In some embodiments, the total illuminable surface area could be have a value approximately in the range between fifty square inches and one hundred and fifty square inches. In one embodiment, the total illuminable surface area could have a value of approximately one hundred and forty square inches.

The embodiments provide an upper covering member that is almost completely illuminated in an illuminated state of the article of footwear. This provides near full-article illumination, which may facilitate improved functionality and different aesthetics over embodiments that provide illumination in a relatively small area of the article of footwear (e.g., less than 10% of the total exterior area of the article). Full upper (or upper assembly) illumination may allow for the creation of visual effects that could not be achieved with limited patches of lighting, as smaller patches might be obscured by viewing angle, etc.

Embodiments can include provisions for providing power to a lighting system. FIG. 6 illustrates a schematic exploded view of article 100. Specifically, FIG. 6 illustrates optional elements of sole structure 110, as well as upper 102 and upper covering member 104 (comprising upper assembly 106). FIG. 7 illustrates a schematic isometric view of upper 102 and sole structure 110, without upper covering member 104.

Referring to FIGS. 6 and 7, some embodiments can include power provisions such as power sources/supplies, charging provisions, power switches and/or controls as well as possibly other provisions. Embodiments may include various kinds of batteries to power a lighting panel, including disposable and/or rechargeable batteries. Examples of different types of disposable batteries include, but are not limited to: zinc-carbon, zinc-chloride, alkaline, silver-oxide, lithium disulfide, lithium-thionyl chloride, mercury, zinc-air, thermal, water-activated, nickel oxhydroxide, and paper batteries. Examples of rechargeable batteries include, but are not limited to nickel-cadmium, nickel-metal hydride and rechargeable alkaline batteries. Other embodiments could incorporate another type of device capable of generating and storing electricity. For example, in one embodiment, an article could be a piezoelectric device capable of generating and storing electricity for powering a lighting panel.

FIG. 7 illustrates an exemplary location for one or more components of a power system. In this case, a power component 400 (shown in phantom) may be integrated into tongue 122. Power component 400 is indicated schematically for purposes of illustration. In some embodiments, power component 400 could comprise a power source (e.g., a rechargeable battery). In other embodiments, power component 400 could comprise a power switch (e.g., an on/off button that may be squeezed by a user to switch between an illuminated state and a non-illuminated state). In still other embodiments, power component 400 could comprise both a power source as well as a power switch.

In FIG. 7, another optional power component 402 is also shown. Power component 402 may comprise a battery, switch and/or other component. In this case, power component 402 is integrated into sole structure 110. In some embodiments, both power component 400 and power component 402 could be utilized. For example, power component 400 could comprise a switch that could be activated by a user (e.g., by squeezing tongue 122 around power component 400). Also, power component 402 could be a rechargeable battery. However, in other embodiments, power component 400 and/or power component 402 could be optional. Moreover, in other embodiments one or more power components could be disposed in any other portions of an article, including any portions of an upper, a sole structure and/or an upper covering member.

Figure 8:
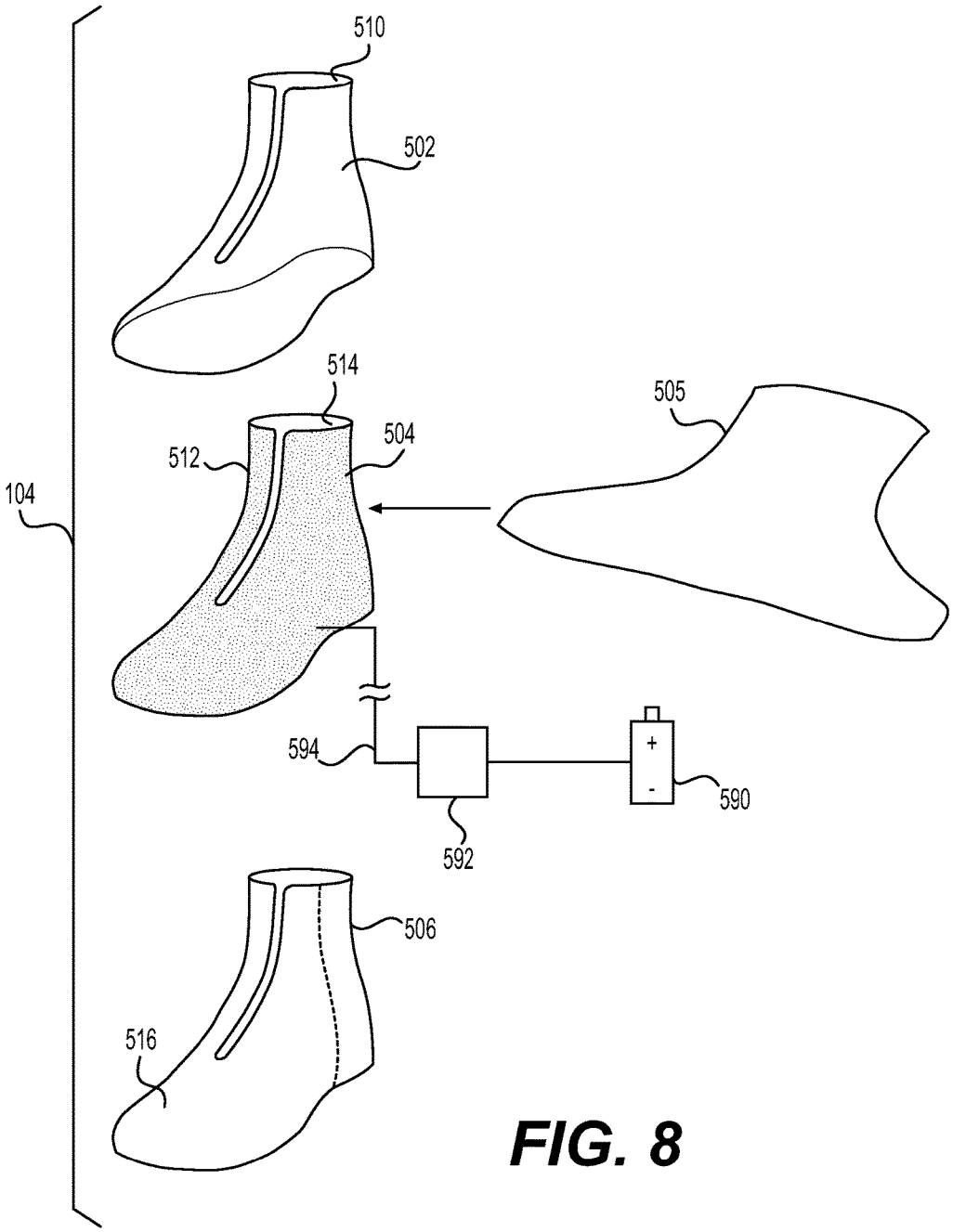
FIG. 8 is an isometric exploded view of multiple layers of an embodiment of an outer covering member.

It will be understood that any other components necessary for connecting a power source and/or power switch to an illuminable component may be provided, including various kinds of wires or other circuitry elements (such as microprocessors, etc.). For example, in some embodiments, wires (not shown) may connect power component 400 and/or power component 402 with a lighting panel within upper covering member 104. One possible wiring configuration is shown in FIG. 8 and discussed below.

Referring to FIG. 6, some embodiments may include one or more sensors. In some embodiments, article 100 could incorporate a sensor panel 300. Sensor panel 300 provides one possible example for a package of sensors 302 that could be incorporated into article 100. Sensor panel 300 could be integrated into sole structure 110 in some embodiments. Alternatively, in other embodiments, sensor panel 300 could be associated with upper 102 and/or upper covering member 104.

Sensor panel 300 could comprise a variety of different kinds of sensors. Moreover, sensors need not be disposed on a sensory panel and some sensors could be disposed in any other location of an article. Exemplary sensors include, but are not limited to: accelerometers, pressure and/or weight sensors, force and/or compression sensors, piezoelectric sensors, biometric sensors as well as possibly other kinds of sensors. Some embodiments may use one or more of the sensors, features, methods, systems and/or components disclosed in the following documents, each of which is hereby incorporated by reference in their entirety: Case et al., U.S. Pat. No. 8,112,251, issued Feb. 7, 2012; Riley et al., U.S. Pat. No. 7,771,320, issued Aug. 10, 2010; Darley et al., U.S. Pat. No. 7,428,471, issued Sep. 23, 2008; Amos et al., U.S. Patent Application Publication Number 2012/0291564, published Nov. 22, 2012; Schrock et al., U.S. Patent Application Publication Number 2012/0291563, published Nov. 22, 2012; Meschter et al., U.S. Patent Application Publication Number 2012/0251079, published Oct. 4, 2012; Molyneux et al., U.S. Patent Application Publication Number 2012/0234111, published Sep. 20, 2012; Case et al., U.S. Patent Application Publication Number 2012/0078396, published Mar. 29, 2012; Nurse et al., U.S. Patent Application Publication Number 2011/0199393, published Aug. 18, 2011; Hoffman et al., U.S. Patent Application Publication Number 2011/0032105, published Feb. 10, 2011; Schrock et al., U.S. Patent Application Publication Number 2010/0063778, published Mar. 11, 2010; Shum, U.S. Patent Application Publication Number 2007/0021269, published Jan. 25, 2007; Schrock et al., U.S. Patent Application Publication Number 20130213147, now U.S. patent application Ser. No. 13/401,918, filed Feb. 22, 2012, titled "Footwear Having Sensor System"; Schrock et al., U.S. Patent Application Publication Number 2013/0213144, now U.S. patent application Ser. No. 13/401,910, filed Feb. 22, 2012, titled "Footwear Having Sensor System."

In the exemplary embodiment, package of sensors 302 may comprise a plurality of force and/orcompression sensors, indicated in phantom in FIG. 6. Each compression sensor could be located in a specific region under the sole of the foot such that they provide information about the general force distribution throughout the sole during various activities. The embodiment of FIG. 6 may use a configuration as provided, for example, in U.S. application Ser. No. 13/401,910, previously incorporated by reference. Alternatively, any other configuration of sensors could be used.

Information gathered from compression sensors 302 may be utilized to control a lighting panel within the article (e.g., lighting panel 504 discussed below and shown in FIG. 8). In some cases, input from compression sensors 302 may be used to switch a lighting component between an illuminated and a non-illuminated state. For example, an article could be configured to light up when any force above a threshold force is applied to one or more compression sensors. Alternatively, an article could be maintained in an illuminated state and switched off when a threshold force is applied to one or more compression sensors. Of course, it is contemplated that in still other embodiments other operational modes of a lighting system (or lighting panel) could be changed in response to compression information (such as the amount of compression and/or distribution of forces over sensors in different locations). As another example, an article could be configured to flicker (e.g., changing between an illuminated state and a non-illuminated state in quick succession) at a rate corresponding to a step rate of the user (as determined by compression sensor readings over time). As still another example, compression sensor data could be used to determine when a wearer is jumping, and the system could switch between the illuminated state and non-illuminated state during jumping (e.g., only illuminate when a user jumps).

FIG. 8 illustrates an exploded view of an exemplary embodiment of an upper covering member that provides an exemplary layered construction for the upper covering member. In some embodiments, an upper covering member could be comprised of one or more layers. In some embodiments, an upper covering member could include an outer layer, an intermediate layer and an inner layer. Referring to FIG. 8, upper covering member 104 is comprised of three distinct layers or components, including an outer film layer 502, a lighting panel layer 504 and an inner fabric layer 506 (e.g., a fabric lining). It will be understood that this particular configuration is only intended as an exemplary configuration and in other embodiments one or more of these layers could be optional. Furthermore, in some other embodiments additional layers could be used that are not included in the embodiment of FIG. 8.

As indicated in FIG. 8, the layers may be combined such that outer film layer 502 is disposed over lighting panel layer 504, and inner fabric layer 506 is disposed within lighting panel layer 504. In other words, an interior surface 510 of outer film layer 502 may contact, and bond with, an exterior surface 512 of lighting panel layer 504. Likewise, an interior surface 514 of lighting panel layer 504 may contact, and bond with, an exterior surface 516 of inner fabric layer 506. Methods of bonding these different layers could vary and could be selected according to material properties of each layer as well as desired bonding strengths and part geometries. In an exemplary embodiment, outer film layer 502 could be electrostatically bonded to lighting panel layer 504. In some embodiments, lighting panel layer 504 could be bonded to inner fabric layer 506 using stitching and/or adhesives. It is also contemplated that in some embodiments, inner fabric layer 506 and outer film layer 502 could be bonded directly to one another at their respective peripheries, thereby forming a closed pocket or interior region for holding lighting panel layer 504.

In different embodiments, outer film layer 502 could be made of a variety of different materials. Exemplary materials that could be used include various kinds of polymer films, such as thermoplastic polyurethane (TPU) films. In other embodiments, other materials could be used. Materials may be selected according to various factors including desired transparency, durability, ease of bonding with a lighting panel as well as other factors.

Figure 9:
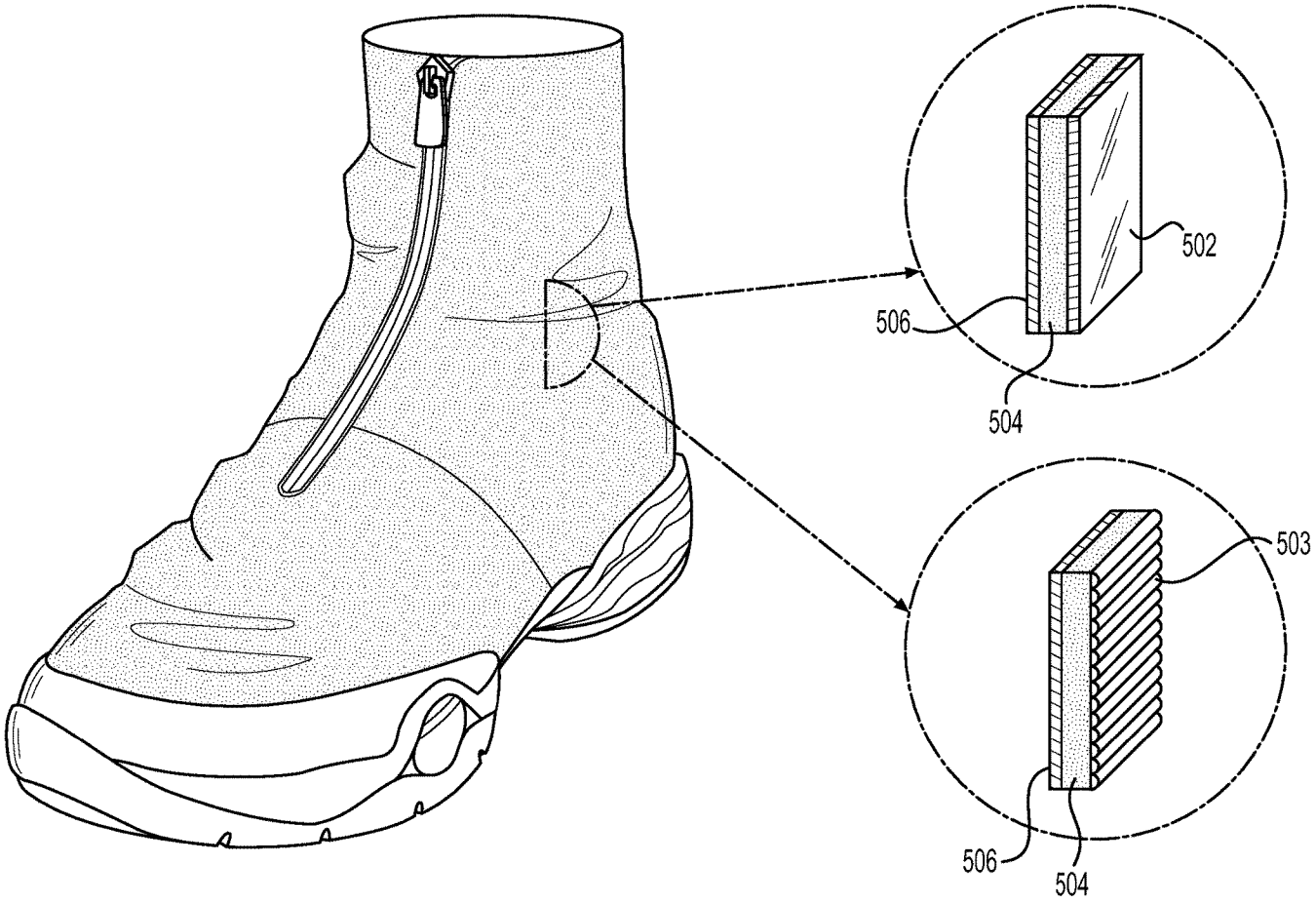
FIG. 9 is a schematic view of an article of footwear including two enlarged views of optional configurations for an outer layer.

As shown in FIG. 9, an outer film layer could be provided with a variety of different physical configurations. Different configurations may allow for different visual effects. For example, FIG. 9 depicts a first optional configuration where an outer film layer 502 has the form of a substantially flat and transparent film layer. Such a configuration may allow outer film layer 502 to act as a protective layer to underlying layers, while also maximizing the amount of light that is emitted through the exterior surface of upper covering member 104.

In an alternative configuration, also shown for convenience in FIG. 9, another embodiment of outer film layer 503 could be configured as a lenticular layer. Such a lenticular configuration could provide for different kinds of visual properties, providing different visual patterns to be visible on an exterior surface of upper covering member 104 depending on the viewing angle. In still other embodiments, an outer film layer could be configured in other ways to achieve desired optical/visual effects, and could include additional coloring/dyes, textures and/or other provisions that might affect the appearance of upper covering member 104 in the illuminated and/or non-illuminated states.

Lighting panel layer 504 includes provisions for producing and emitting light. Thus, it may be understood that light panel layer 504 is not simply a reflective layer or a layer that only transmits light. As used herein, then, a lighting panel layer is a layer that serves as a source of illumination.

In different embodiments, lighting panel layer 504 may be comprised of a variety of different materials. In some embodiments, lighting panel layer 504 could comprise an electroluminescent panel (or EL panel). Exemplary EL panel technologies that could be used include, but are not limited to: light-emitting capacitor (LEC) panels, powder phosphor-based electroluminescent panels, thin film electroluminescent materials as well as other kinds of technologies known in the art. Although the exemplary embodiments use EL panel lighting, other embodiments could include any other kind of lighting technologies that could be incorporated into a layer in an upper covering member and/or upper.

In at least some embodiments, lighting panel layer 504 could be manufactured as a single panel. An exemplary flat configuration 505 (e.g., unrolled or unassembled) of a lighting panel is also shown in FIG. 8. In one embodiment, the single panel configuration could be manufactured as a two-dimensional panel with a geometry that can be assembled into a three-dimensional upper-like geometry.

FIG. 8 also illustrates a schematic power and control system for lighting panel layer 504. Referring to FIG. 8, a wire 594 may connect lighting panel layer 504 to a battery 590. Optionally, in some cases, a control unit 592 may be connected to lighting panel layer 504 by wire 594 (for example, between battery 590 and lighting panel layer 504). Thus, in some cases, control unit 592 could control the activation of lighting panel layer 504 in response to sensed information and/or in response to a power switch condition. Although a single wire is shown in the exemplary embodiment, other embodiments could use two or more wires arranged in any configuration.

Control unit 592 may include a microprocessor, RAM, ROM, and software all serving to monitor and control one or more lighting panels. For example, control unit 592 is capable of receiving signals from numerous sensors, devices, and systems associated with article 100. The output of various devices is sent to control unit 592 where the device signals may be stored in an electronic storage, such as RAM. Both current and electronically stored signals may be processed by a central processing unit (CPU) in accordance with software stored in an electronic memory, such as ROM.

In different embodiments, inner fabric layer 506 may be comprised of a variety of different materials. Exemplary materials include, but are not limited to: woven fabrics, non-woven fabrics as well as other kinds of textile materials commonly used in manufacturing various layers in an upper. Alternatively, in some cases, inner fabric layer 506 could be removed and/or replaced with an inner film layer. Using an outer and inner film layer may provide an exterior casing for lighting panel layer 504.

Figure 10:
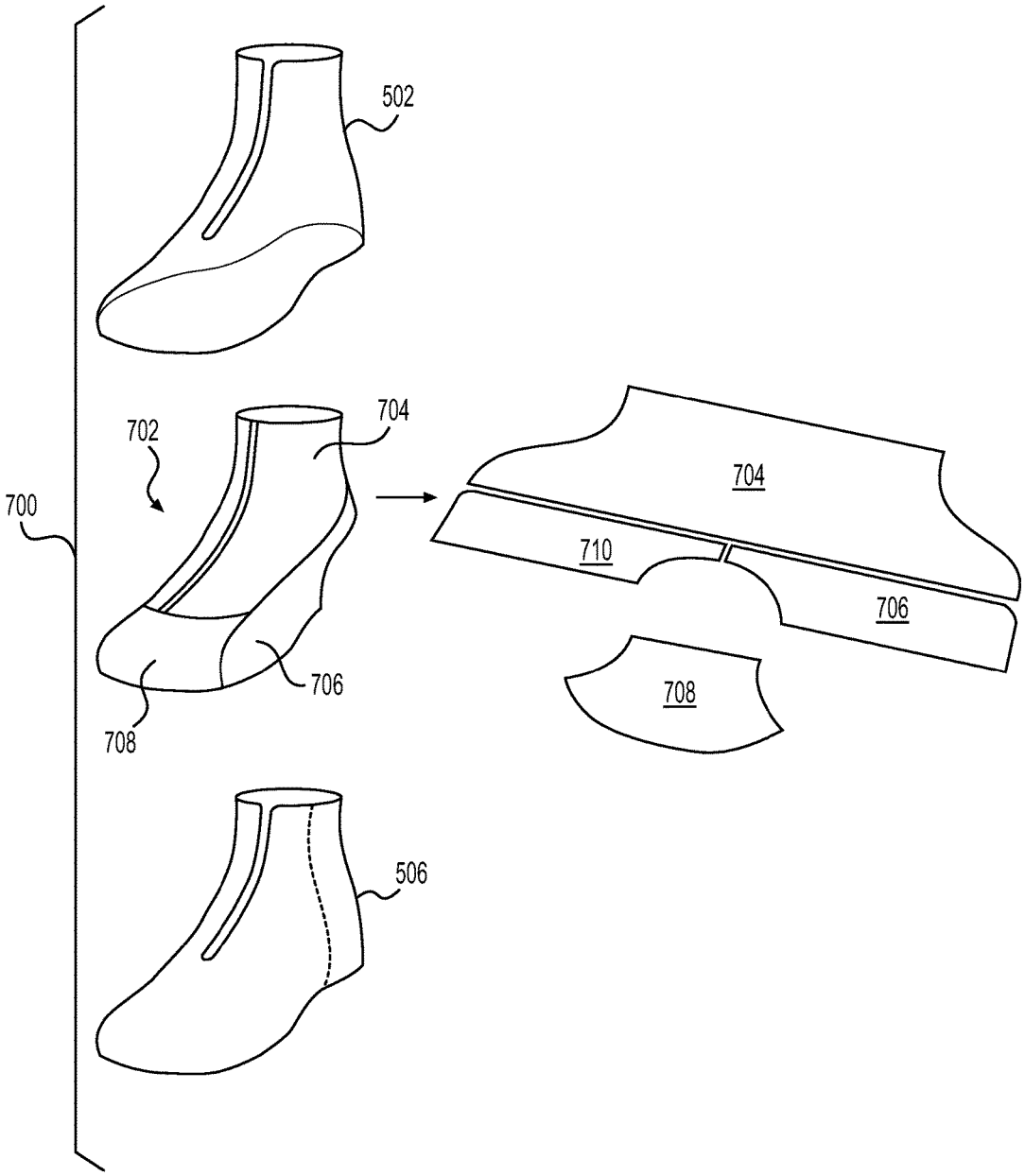
FIG. 10 is an isometric exploded view of multiple layers of another embodiment of an outer covering member.

FIG. 10 illustrates an exploded isometric view of an alternative layered configuration for another embodiment of an upper covering member. Referring to FIG. 10, upper covering member 700 may be configured with an outer film layer 502 and an inner fabric layer 506. In contrast to the previous embodiment, however, upper covering member 700 comprises multiple disjoint (e.g., separable) lighting panels. Specifically, upper covering member 700 includes panel assembly 702, which is comprised of a first lighting panel 704, a second lighting panel 706, a third lighting panel 708 and a fourth light panel 710. It should be understood that this particular configuration is only intended as an example and in other embodiments any other number and/or arrangement of lighting panels could be used.

Panel assembly 702 may be seen to have a similar surface area to outer film layer 502 and inner fabric layer 506. In other words, panel assembly 702 may extend through the entire surface area of upper covering member 700. This allows panel assembly 702, though comprised of smaller discrete panels, to provide illumination throughout the majority of upper covering member 700.

Embodiments can include provisions for providing illumination directly within an upper, rather than just an upper covering member. In some embodiments, the upper of an article may incorporate lighting provisions, such as a lighting panel. In some embodiments, a majority of the exposed surface of the upper may be configured for illumination.

Figure 11:
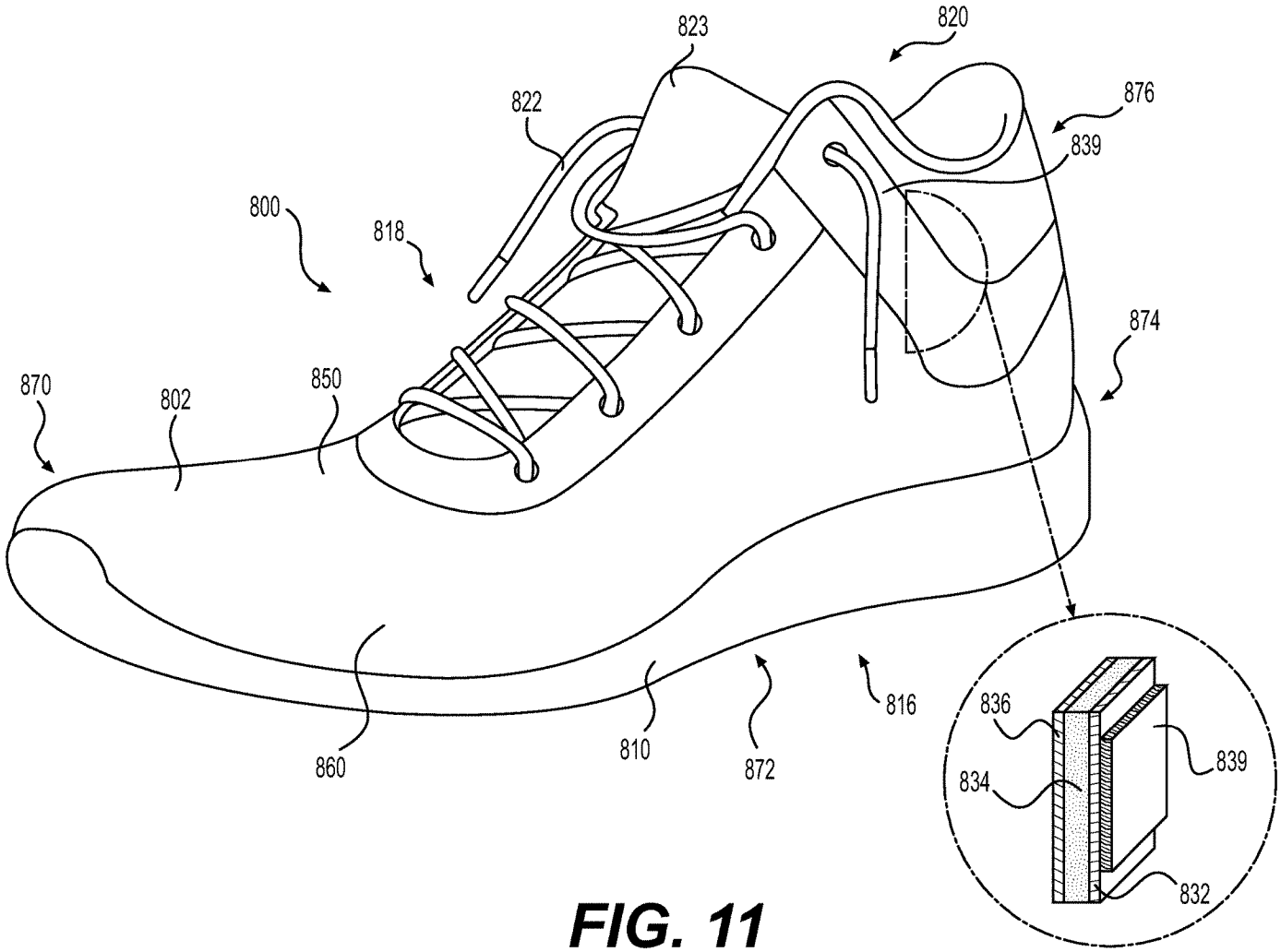
FIG. 11 is a schematic view of an embodiment of an article of footwear in a non-illuminated state.
Figure 12:
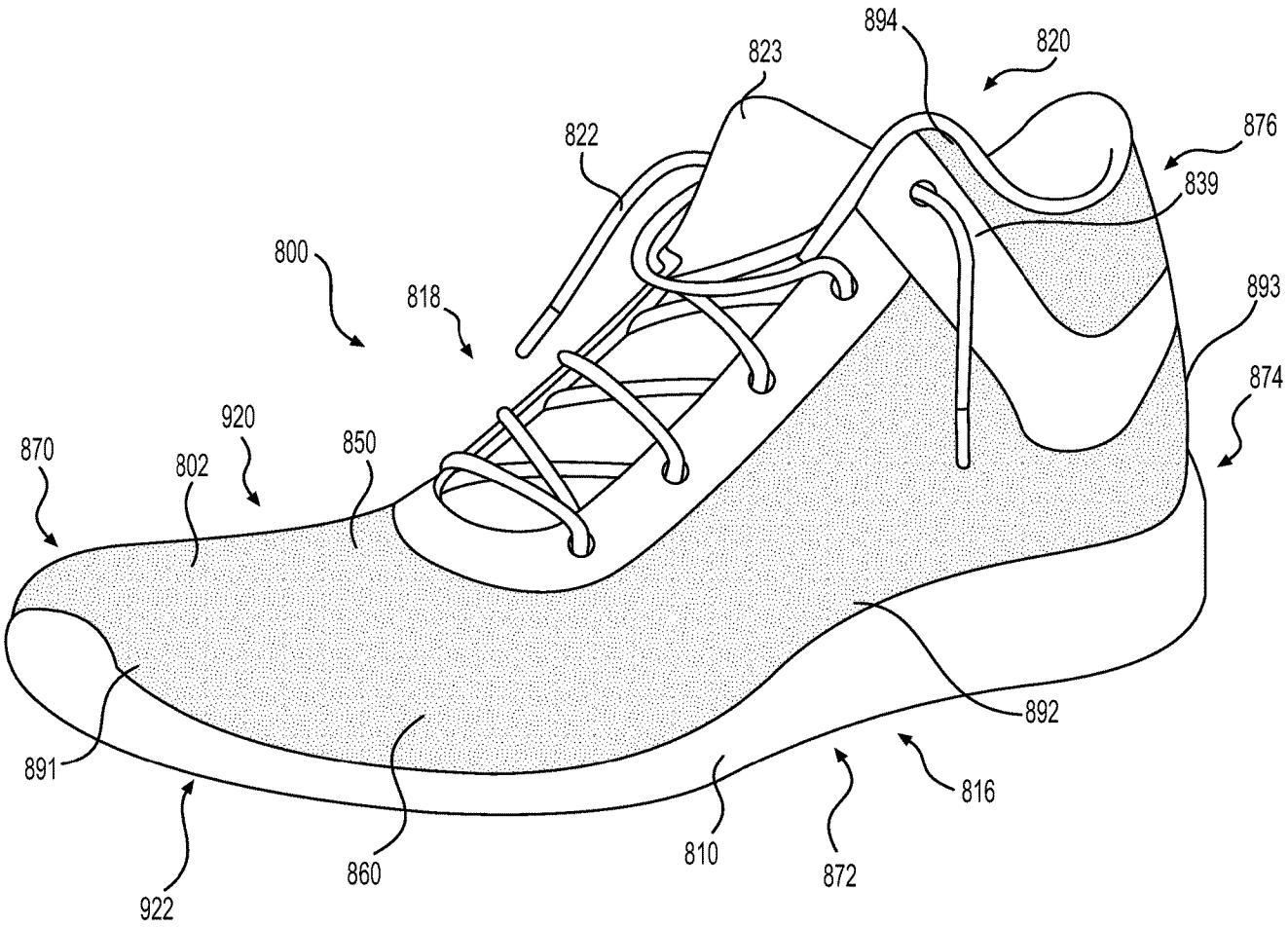
FIG. 12 is a schematic view of an embodiment of an article of footwear in an illuminated state.

FIGS. 11 and 12 illustrate another embodiment of an article of footwear 800. Article of footwear 800 may include an upper 802 and a sole structure 810. Sole structure 810 may be configured with any of the various provisions discussed above with respect to sole structure 110.

Upper 802 may include various provisions for receiving a foot and securing an article around a foot. For example, upper 802 could include opening 820 as well as laces 822 for tightening opening 820 around a foot. Upper 802 could also include tongue 823 that provides padding for the top of a foot.

As seen in FIG. 11, upper 802 may be comprised of one or more layers, including an outer film layer 832, a lighting panel layer 834 and an inner fabric layer 836. In some embodiments, these various layers could be substantially similar in structure, geometry and/or material construction to similar layers disclosed as part of upper covering member 104 (shown in FIG. 8, for example). In this case, a lighting panel layer 834 may extend throughout a majority of upper 802 to provide illumination when article 800 is placed in an illuminated state.

In some embodiments, a trim layer 839 may be provided on a portion of upper 802. Trim layer 839 may be disposed over layer 832, layer 834 and layer 836. In some cases, light from lighting panel layer 834 may not be visible through trim layer 839. However, in some cases, the optical properties of trim layer 839 could be selected so that some light can be visible through trim layer 839.

Referring to FIGS. 11-12, upper 802 may be divided into forefoot portion 870, midfoot portion 872 and heel portion 874. Upper 802 may also include an ankle portion 876. In addition, upper 802 may include lateral side 816 and medial side 818. In particular, lateral side 816 and medial side 818 may be opposing sides of upper 802. Furthermore, both lateral side 816 and medial side 818 may extend through forefoot portion 870, midfoot portion 872, heel portion 874 and ankle portion 876.

In the exemplary embodiment of 11-12, upper 802 consists of forefoot portion 870, midfoot portion 872, heel portion 874 and ankle portion 876. In other words, every portion of upper 802 is associated with one of forefoot portion 870, midfoot portion 872, heel portion 874 and ankle portion 876. Further, midfoot portion 872 may extend continuously between forefoot portion 870 and heel portion 874.

Upper 802 may comprise an exposed surface 850. Exposed surface 850 includes all those portions of upper 802 that can be seen on article 800 when article 800 is worn, but not portions that are hidden and/or covered by other provisions (e.g., portions hidden by external support elements, trim, etc.). Furthermore, the exterior surface of article 800 may be the combined exposed surfaces of upper 802 and sole structure 810.

The illumination of article 800 may be characterized by the percentage of the exposed surface of upper 802 that is illuminated in the illuminated state. In some embodiments, at least 50% of the exposed surface may be illuminated in the illuminated state. In some other embodiments, at least 80% of the exposed surface may be illuminated in the illuminated state. In some other embodiments, at least 90% of the exposed surface may be illuminated in the illuminated state. In some other embodiments, at least 95% of the exposed surface may be illuminated in the illuminated state. In the embodiment shown in FIGS. 11-12, substantially all, or approximately 95% to 100%, of the exposed surface of upper 802 may be illuminated in the illuminated state.

An illumination zone in an upper may extend continuously through various portions of the upper. An illumination zone may be disposed in one or more portions, including a forefoot portion, a midfoot portion, a heel portion, an ankle portion and/or a combination of two or more portions. In some embodiments, an illumination zone could extend continuously from a forefoot portion to a midfoot portion. In other embodiments, an illumination zone could extend continuously from a midfoot portion to a heel portion. In other embodiments, an illumination zone could extend continuously from a forefoot portion to a heel portion. In other embodiments, an illumination zone could extend continuously from a heel portion to an ankle portion. In still other embodiments, an illumination zone could extend continuously from a medial side of an upper to a lateral side of the upper.

In the exemplary embodiment of FIGS. 11-12, upper 802 includes a single illumination zone 860 that extends continuously throughout substantially all of exposed surface 850. Specifically, illumination zone 860 extends continuously through forefoot portion 870, midfoot portion 872, heel portion 874 and ankle portion 876. Illumination zone 860 also extends on both lateral side 816 and medial side 818. Thus, as may be seen in FIGS. 11-12, each of forefoot portion 870, midfoot portion 872, heel portion 874 and ankle portion 876, on both the lateral side 816 and medial side 818, are illuminated in the illuminated state.

As seen in FIGS. 11-12, illumination zone 860 may extend to the lower periphery and upper periphery of upper 802. In particular, as best seen in FIG. 12, illumination zone 860 may extend to a forward-most edge 891 of upper 802. Likewise, illumination zone 860 may extend to a rearward-most edge 893 of upper 802. Illumination zone 860 may also extend to a lower peripheral lateral edge 892 (FIG. 12) and to lower peripheral medial edge (not shown). Further, illumination zone 860 may extend to upper peripheral edge 894 of upper 802, which provides a boundary to opening 820. In some cases, the upper periphery, or upper peripheral edge 894, of upper 802 may be associated with a cuff portion of article 800.

The near full-article illumination provided by the embodiments may be characterized by the total illuminated area relative to the entire exterior or exposed surface area of an upper area. Here, the upper area is the portion of the exposed surface of an article that does not include the exposed surface area of the sole structure, which may not be configured for illumination in some embodiments. For example, referring to the embodiment shown in FIG. 12, article of footwear 800 may have a first exposed surface 920 and a second exposed surface 922 corresponding to the exposed surfaces of upper 802 and sole structure 810, respectively. Being distinct components, the first exposed surface 920 of upper 802 and the second exposed surface 922 of sole structure 810 are distinct and disjoint (e.g., non-overlapping). Moreover, the first exposed surface 920 and the second exposed surface 922 together comprise the entire total exposed surface of article of footwear 800.

In different embodiments, the illuminable area of first exposed surface 920 (e.g., the total expose surface area of upper 802 that is illuminated in the illuminated state) may vary. In some embodiments, at least fifty percent of first exposed surface 920 is illuminated when article of footwear 800 is in the illuminated state. In some embodiments, at least seventy-five percent of first exposed surface 920 is illuminated when article of footwear 800 is in the illuminated state. In some embodiments, at least ninety percent of first exposed surface 920 is illuminated when article of footwear 800 is in the illuminated state. In some embodiments, at least ninety-five percent of first exposed surface 920 is illuminated when article of footwear 800 is in the illuminated state. In still other embodiments, substantially all of first exposed surface 920 may be illuminated in the illuminated state. In the embodiment shown in FIG. 12, some portions first exposed surface 920 may not be illuminable, and therefore this embodiment depicts an example in which approximately seventy to ninety-five percent of first exposed surface 920 is illuminated when article 800 is in the illuminated state.

It will be understood that this discussion of the percent of an upper surface area that is illuminable could be applied to other embodiments. In particular, the embodiments depicted in FIGS. 1-10, which include an upper covering member, may be likewise characterized by a first exposed surface (e.g., of upper covering member 104) and a second exposed surface (e.g., of sole structure 110). In such an embodiment, the total illuminated area of the first exposed surface could likewise vary in the range between fifty percent and approximately one-hundred percent of the first exposed surface area.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. An article of footwear, comprising:

an upper and a sole structure;

a first exposed surface corresponding to an exposed surface of the upper;

a second exposed surface corresponding to an exposed surface of the sole structure, wherein the first exposed surface is disjoint from the second exposed surface, and wherein the first exposed surface and the second exposed surface together comprise a total exposed surface for the article of footwear;

a forefoot portion, a midfoot portion and a heel portion;

a lighting panel layer affixed to the upper, wherein the lighting panel layer serves as a source of illumination;

the article of footwear having an illuminated state and a non-illuminated state;

wherein an entirety of the lighting panel layer is illuminated when the article of footwear is in the illuminated state;

wherein the lighting panel layer extends continuously from the forefoot portion to the midfoot portion and continuously from a lower periphery of the upper to an upper periphery of the upper;

wherein the article of footwear further includes an upper covering member that is disposed exterior to the upper and wherein the first exposed surface is comprised of an exposed surface of the upper covering member; and wherein the upper covering member extends above an uppermost edge of the upper.

2. The article of footwear according to claim 1, wherein the lighting panel layer extends continuously from the midfoot portion to the heel portion.

3. The article of footwear according to claim 1, wherein the lighting panel layer extends continuously from the forefoot portion to the heel portion.

4. The article of footwear according to claim 1, wherein the lighting panel layer extends continuously from a medial side of the article of footwear to a lateral side of the article of footwear.

5. The article of footwear according to claim 1, wherein the article of footwear includes an ankle portion and wherein the lighting panel layer extends to the ankle portion.

6. The article of footwear according to claim 1, wherein the lighting panel layer extends between a lower peripheral medial edge and a lower peripheral lateral edge.

7. The article of footwear according to claim 1, wherein the first exposed surface is substantially greater than the second exposed surface.

8. The article of footwear according to claim 1, wherein the first exposed surface is comprised of an exposed surface area of the upper.

9. The article of footwear according to claim 1, wherein at least seventy-five percent of the first exposed surface is illuminated when the article of footwear is in the illuminated state.

10. The article of footwear according to claim 1, wherein at least ninety percent of the first exposed surface is illuminated when the article of footwear is in the illuminated state.

11. The article of footwear according to claim 1, wherein at least ninety-five percent of the first exposed surface is illuminated when the article of footwear is in the illuminated state.

12. The article of footwear according to claim 1, wherein substantially all of the first exposed surface is illuminated when the article of footwear is in the illuminated state.

13. An article of footwear, comprising:

a sole structure, an upper and an upper covering member, the upper covering member being exterior to the upper and covering at least a portion of the upper;

the upper covering member having an exposed surface;

the article of footwear having an illuminated state and a non-illuminated state;

wherein the upper covering member comprises a lighting panel layer for illuminating an illumination zone associated with the exposed surface;

wherein an entirety of the lighting panel layer is illuminated when the article of footwear is in the illuminated state;

wherein the lighting panel layer extends continuously from a lower periphery of the upper covering member to an upper periphery of the upper covering member, wherein the lower periphery is disposed adjacent to the sole structure and wherein the upper periphery is associated with a cuff portion of the article of footwear; and wherein an entire uppermost edge of the upper covering member is unattached to the upper.

14. The article of footwear according to claim 13, wherein the upper covering member is permanently attached to the upper.

15. The article of footwear according to claim 13, wherein the upper includes a lace for tightening the upper, wherein the upper covering member includes a zipper, and wherein the zipper can be used to open the upper covering member to provide access to the lace of the upper.

16. The article of footwear according to claim 13, wherein the article of footwear includes an external heel counter and wherein an exterior surface of the external heel counter is distinct from the exposed surface of the upper covering member.

17. The article of footwear according to claim 13, wherein the lower periphery is associated with a forwardmost edge, a rearward most edge, a lower peripheral medial edge and a lower peripheral lateral edge of the upper covering member.

18. The article of footwear according to claim 13, wherein the upper covering member covers at least eighty percent of an upper exterior surface of the upper.

19. The article of footwear according to claim 13, wherein substantially all of the exposed surface is illuminated in the illuminated state.

20. An article of footwear, comprising:

a sole structure, an upper and an upper covering member;

the upper covering member being disposed outwardly of the upper and the upper covering member covering a majority of the upper;

the upper covering member having a forefoot portion, a midfoot portion and a heel portion, wherein the midfoot portion extends continuously between the forefoot portion and the heel portion;

wherein the article of footwear has a non-illuminated state and an illuminated state;

wherein the article of footwear includes a lighting panel layer, wherein the lighting panel layer serves as a source of illumination, an entirety of the lighting panel layer being illuminated when the article of footwear is in the illuminated state;

wherein the lighting panel layer extends continuously from the forefoot portion to the heel portion and continuously from a lower periphery of the upper covering member to an upper periphery of the upper covering member; and wherein the upper covering member encircles a back portion of the upper.

21. The article of footwear according to claim 20, wherein the lighting panel layer extends continuously from a medial side to a lateral side of the upper covering member.

22. The article of footwear according to claim 20, wherein lighting panel layer extends to a forward-most edge of the upper covering member.

23. The article of footwear according to claim 20, wherein the article of footwear includes an external heel counter and wherein a rearward-most edge of the upper covering member is disposed adjacent to an edge of the external heel counter.

24. The article of footwear according to claim 23, wherein the lighting panel layer extends to the rearward-most edge of the upper covering member.

25. The article of footwear according to claim 20, wherein the upper covering member includes a lower peripheral medial edge and a lower peripheral lateral edge, and wherein the lighting panel layer extends to the lower peripheral medial edge and wherein the lighting panel layer extends to the lower peripheral lateral edge.

26. The article of footwear according to claim 20, wherein the upper covering member includes an ankle portion and wherein the lighting panel layer extends continuously from the heel portion to the ankle portion.

27. The article of footwear according to claim 26, wherein the lighting panel layer extends through a substantial entirety of the upper covering member.

28. An article of footwear, comprising:

a sole structure, an upper and an upper covering member;

the upper covering member being disposed outwardly of the upper and the upper covering member covering a majority of the upper;

the upper covering member further comprising an outer layer, an intermediate layer and an inner layer, wherein the intermediate layer is a lighting panel layer; wherein the lighting panel layer serves as a source of illumination;

wherein the lighting panel layer extends continuously from a lower periphery of the upper covering member to an upper periphery of the upper covering member;

wherein the intermediate layer separates the outer layer and the inner layer;

wherein the article of footwear has a non-illuminated state and an illuminated state;

wherein an entirety of the lighting panel layer is illuminated when the article of footwear is in the illuminated state;

wherein the intermediate layer is illuminated when the article of footwear is in the illuminated state;

wherein an entire uppermost edge of the upper covering member is unattached to the upper; and wherein the upper covering member encircles a back portion of the upper.

29. The article of footwear according to claim 28, wherein the article of footwear includes a battery disposed in the upper.

30. The article of footwear according to claim 29, wherein the battery is disposed in a tongue of the upper.

31. The article of footwear according to claim 29, wherein the battery is disposed in the sole structure.

32. The article of footwear according to claim 28, wherein the intermediate layer extends through at least half of a total area of an upper covering member.

33. The article of footwear according to claim 28, wherein the intermediate layer extends through at least ninety percent of the upper covering member.

34. The article of footwear according to claim 28, wherein the upper covering member includes a fastener and wherein the fastener can be used to open a portion of the upper covering member, thereby providing access to the upper.

35. The article of footwear according to claim 34, wherein the intermediate layer is comprised of a plurality of distinct lighting panels.

36. The article of footwear according to claim 28, wherein the outer layer is a transparent film layer.

37. The article of footwear according to claim 28, wherein the outer layer is a lenticular layer.

38. The article of footwear according to claim 28, wherein the intermediate layer is comprised of an electroluminescent panel.

39. An article of footwear, comprising:

a sole structure an upper, and an upper covering member;

the upper covering member having an exposed surface and the upper covering member being disposed outwardly of the upper;

the article of footwear having an illuminated state and a non-illuminated state;

wherein the upper covering member includes a lighting panel layer associated with the exposed surface and wherein the lighting panel layer extends continuously from a lower periphery of the upper covering member to an upper periphery of the upper covering member, wherein the lower periphery is disposed adjacent to the sole structure;

wherein the lighting panel layer serves as a source of illumination;

wherein an entirety of the lighting panel layer is illuminated when the article of footwear is in the illuminated state;

wherein the lighting panel layer extends continuously from a lower periphery of the upper covering member to an upper periphery of the upper covering member;

wherein the upper periphery of the upper covering member extends above an uppermost edge of the upper;

wherein upper periphery of the upper covering member is unattached to the upper; and wherein the upper covering member encircles a back portion of the upper.

40. The article of footwear according to claim 39, wherein at least seventy percent of the exposed surface is illuminated in the illuminated state.

41. The article of footwear according to claim 40, wherein substantially all of the exposed surface is illuminated in the illuminated state.

42. The article of footwear according to claim 39, wherein at least ninety percent of the exposed surface is illuminated in the illuminated state.

43. The article of footwear according to claim 39, wherein the upper includes an electroluminescent panel layer.

* * * * *